United States Patent [19]

Yamada

[11] Patent Number: 4,659,209

[45] Date of Patent: Apr. 21, 1987

[54] EXPOSURE MODE SELECTRO FOR AUTOMATICALLY SELECTING AUTOMATIC EXPOSURE CONTROL MODE FOR ELECTROPHOTOGRAPHIC COPYING MACHINE

[75] Inventor: Yoshikado Yamada, Kashihara, Japan

[73] Assignee: Sharp Kabushiki Kaisha, Osaka, Japan

[21] Appl. No.: 707,202

[22] Filed: Mar. 1, 1985

[30] Foreign Application Priority Data

Mar. 2, 1984 [JP] Japan ..... 59-41075
Mar. 2, 1984 [JP] Japan ..... 59-41076

[51] Int. Cl.[4] ..... G03G 15/00

[52] U.S. Cl. ..... 355/14 E; 355/55; 355/69; 355/68

[58] Field of Search ..... 355/68, 14 R, 14 E, 355/69, 55, 56

[56] References Cited

U.S. PATENT DOCUMENTS 4,222,660 9/1980 Furuichi et al. ..... 355/14 R
4,361,395 11/1982 Washio et al. ..... 355/14 R
4,394,087 7/1983 Irie et al. ..... 355/14 R X
4,564,287 1/1986 Suzuki et al. ..... 355/14 E X

*Primary Examiner*—Michael L. Gellner
*Assistant Examiner*—D. Rutledge
*Attorney, Agent, or Firm*—Birch, Stewart, Kolasch & Birch

[57] ABSTRACT

An electrophotographic copying machine of the type in which an automatic exposure control mode and a manual exposure control mode can be selected, includes an automatic exposure control mode selection circuit for automatically selecting the automatic control mode. The automatic exposure control mode selection circuit serves to automatically select the automatic exposure control mode in response to the start of power supply or after the copying machine is left unoperated for a predetermined length of time. A timer is provided for counting this predetermined time. For a copying machine of a magnification-changeable type, the automatic exposure control mode selection circuit is operated to automatically select the automatic exposure control mode in response to the selection of magnification.

4 Claims, 2 Drawing Figures

EXPOSURE MODE SELECTRO FOR AUTOMATICALLY SELECTING AUTOMATIC EXPOSURE CONTROL MODE FOR ELECTROPHOTOGRAPHIC COPYING MACHINE

BACKGROUND OF THE INVENTION

The present invention relates to an electrophotographic copying machine and, more particularly, to an exposure mode selecting circuit for automatically selecting an automatic exposure control mode for an electrophotographic copying machine.

An electrophotographic copying machine produces an electrostatic latent image on a photoreceptor using an optical system. The latent image corresponds to an image on a copy document such as a manuscript or book to be copied. A developing device is provided so that tone particles are electrically adhered to the latent image, so that the latent image becomes visible as a toner image. The toner image is transferred onto a copy paper via a corona transference charger.

Conventionally, the light exposure of the electrophotographic copying machine is controlled depending on the shade of the copy document to be copied. For this purpose, a manual switch for controlling the light exposure has been provided for a manual exposure control mode. Recently, an improved copying machine has been proposed including an automatic exposure controller for automatically controlling the light exposure, the controller being used for an automatic exposure control mode. In such a case, a mode switch is provided for selecting the manual exposure control mode and the automatic exposure control mode. To select either mode, this switch must be operated. Sometimes, it may be troublesome to have to operate this switch. Further, before the copying operation is started, the operator must check the selection of this mode switch, resulting in an extra task.

SUMMARY OF THE INVENTION

Accordingly, it is an object of the present invention to provide an improved electrophotographic copying machine for automatically selecting an automatic exposure control mode.

It is another object of the present invention to provide an improved electrophotographic copying machine for automatically selecting an automatic exposure control mode when the copying machine is left unoperated for a predetermined length of time after a previous operation.

It is a further object of the present invention to provide an improved magnification-changeable type electrophotographic copying machine for automatically selecting an automatic exposure control mode in response to changing magnification of the copying machine.

Briefly described, in accordance with the present invention, an electrophotographic copying machine of the type which functions as a manual exposure control mode and an automatic exposure control mode, includes an automatic exposure control mode selection device for forcibly selecting the automatic exposure control mode in response to the start of power supply. There may be further provided a timer for counting a predetermined time after the operation of the copying machine, and an additiinal automatic exposure control mode selector responsive to the timer for forcibly selecting the automatic exposure control mode after the lapse of the predetermined time. The timer is reset when the automatic exposure control mode selection means is operated during a noncopying cycle, or after the completion of any copying cycle. The timer is set after the reset operation or upon the start of the power supply.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
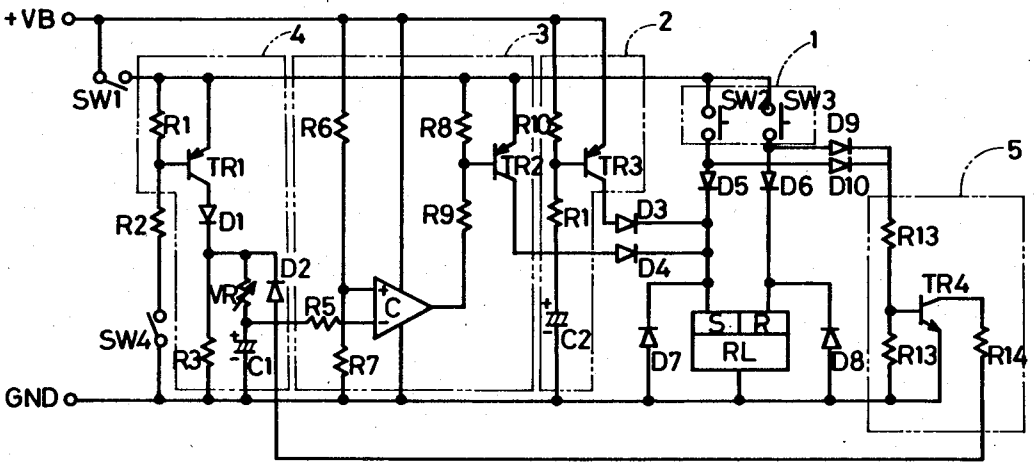
FIG. 1 is a diagram of an automatic mode selection circuit for automatically selecting an automatic exposure control mode for an electrophotographic copying machine according to a first preferred embodiment of the present invention.

FIG. 1 is a diagram of an automatic exposure mode selection circuit for automatically selecting an automatic exposure control mode for an electrophotographic copying machine according to a first preferred embodiment of the present invention.

A mode selector is provided for selecting either an automatic exposure control mode in which a light exposure amount is automatically selected, or a manual exposure control mode in which a light exposure amount is manually selected. The mode selector includes a keep relay RL containing a set terminal S and a reset terminal R. While the keep relay RL is set, the automatic exposure control mode is selected. On the other hand, while it is reset, the manual exposure control mode is selected. When the automatic exposure control mode is selected, the copying machine can optically detect the shade of a copy document to be copied, so that depending on the detected shade, the light exposure amount can be automatically controlled. The document is mounted on a document table.

Several methods of automatically controlling the light exposure are proposed. One of them is as follows: A slit is formed on the document table. Under the slit, a photosensitive sensor is disposed. A reflected light from the document passing through the slit is detected by the photosensitive sensor, to determine the shade of the corresponding part of the document. Depending on the shade, a voltage to be applied to a light source is changed. This control is carried out over the total areas of the document which is relatively moved, so that an optimum light exposure amount for each part of the document can be selected.

To afford the manual exposure control mode, a plurality of voltage levels to be applied to the driving source are changeable at a number of steps. A light exposure control switch disposed on a control panel of the copying machine is operated to desirably select one of the numerous levels.

Because some specific examples of the automatic exposure control and the manual exposure control are conventional, any further description is omitted. The light exposure mode setting circuit of the present invention can be applied to any type of light exposure control device as long as it can function as the automatic exposure control mode and the manual exposure control mode.

A mode selection switch circuit 1 includes two switches SW2 and SW3. An automatic exposure control mode selection switch SW2 is provided in the control panel of the copying machine. This switch SW2 is operated to forcibly set the keep relay RL. A manual exposure control mode selection switch SW3 is also disposed in the control panel of the copying machine. This switch SW3 is operated to forcibly reset the keep relay RL. The mode selection switch circuit 1 is electrically coupled to a source voltage VB via s switch SW1. Only while the switch SW1 is conductive, the switch circuit 1 is placed in an operable condition. The switch circuit 1 is operated in conjunction with the operation of the copying mechanism of the copying machine, so that it is not conductive during the copying cycle while it is conductive in the absence of a copying cycle. The switch SW1 is operated to enable the power supply of the power source VB to the mode selection switch circuit 1, a timer 4, and a time passage mode selection circuit 3.

An automatic exposure mode setting circuit 2 is operated upon the start of power supply. This circuit 2 is electrically coupled to a set terminal S of the keep relay RL via a diode D3. This mode setting circuit 2 includes a transistor TR3, resistances R10 and R11, and a condenser C2 to form a circuit having a time constant for charge. Upon the power supply, this mode setting circuit 2 provides a one-shot pulse to be inputted to the set terminal S of the keep relay RL.

An automatic exposure control mode setting circuit 3 is operated upon a passage of a predetermined time. This mode setting circuit 3 is electrically coupled to the set terminal S of the keep relay RL via a diode D4. This mode setting circuit 3 includes a comparator for comparing the output of the timer 4 and a reference voltage, a transistor TR2 connected to the output side of the comparator C, and some resistances. The reference voltage is formed by dividing the source voltage VB by resistances R6 and R7. The comparator C is operated in such a manner that when the reference voltage applied to a positive input terminal "+" thereof is more than the output voltage of the timer 4 applied to a negative input terminal "−" thereof, the transistor TR2 is placed not conductive. On the other hand, when the output level of the timer 4 is more than the reference voltage, the transistor TR2 is placed conductive. Thus, the automatic exposure control mode setting circuit 3 forcibly sets the keep relay 3 upon the passage of the predetermined time when the output level of the timer 4 exceeds the reference voltage.

The timer 4 includes a CR charge circuit. When a transistor TR1 is conductive, a charge current flows into a condenser C1 from the source voltage VB through a diode D1 and a variable resistance VR, so that the output voltage of the condenser C1, namely, the output voltage of the timer 4 is increased. A resistance R3 functions to discharge the charges of the condenser C1. When the transistor TR1 is turned OFF, the charges of the condenser C1 are abruptly discharged to reset the timer 4. A switch SW4 is interconnected between the base of the transistor TR1 and the ground to become conductive when some specific conditions occur such as the generation of paper jam conditions and the replacement of a developing agent or the like.

A switch operation detection circuit 5 is provided for detecting the operation of the mode selection switch circuit 1. This detection circuit 5 can detect the operation of the automatic exposure mode selection switch SW2 and the manual exposure selection switch SW3 during conditions other than the copying cycles. When the circuit 5 detects such a condition, it permits the charges of the condenser C1 to be abruptly discharged to thereby reset the timer 4. Thus, when either the switch SW2 or the switch SW3 is operated, the transistor TR4 becomes conductive to abruptly discharge the charges of the condenser C1 through the resistance R14 and the transistor TR4.

In operation, once the power voltage is supplied, the automatic exposure mode selection circuit 2 is operated to forcibly set the keep relay RL, so that the copying machine is placed in the automatic exposure control mode. At the same time, the switch SW1 is conductive so that the condenser C1 is started to be charged to start the counting of the timer 4. When such a condition is left without change and the charges of the condenser C1 exceed the reference voltage applied to the negative input terminal of the comparator C, the transistor TR2 of the automatic exposure mode setting circuit 3 upon the passage of the predetermined length of time becomes conductive, so that the keep relay RL is forcibly set via the diode D4. That is, if the copying machine is left unoperated for a predetermined length of time after the power voltage supply, the predetermined length of time being defined by the charge circuit of the condenser C1, it is forcibly set in the automatic exposure mode regardless of the previous exposure mode.

If the manual exposure mode selection switch SW3 is operated within the predetermined length of time, the keep relay RL is reset so that the copying machine is set in the manual exposure selection mode. At the same time, the switch operation detection circuit 5 is operated to abruptly discharge the charges of the condenser C1, whereby the timer 4 is reset. After the timer 4 is reset, the condenser C1 is started to be charged. Then, if the copying machine is left without operation for the predetermined length of time, the keep relay RL is forcibly set, again.

After the copying operation has been completed in either the automatic exposure control mode or the manual exposure control mode, the switch SW1 is turned ON. Upon the ON condition of this switch, the condenser C1 of the timer 4 is started to be charged. That is, this is the same condition of the power supply start. The transistor TR2 becomes conductive if the copying machine is left unoperated until the condenser C1 is charged to a predetermined voltage level, whereby the keep relay RL is set. Thereafter, to select the manual exposure control mode, the switch SW3 is operated to reset the keep relay RL.

If any copying operation is started under the condition that the switch SW1 is conductive, but the charging voltage to the condenser C1 is not up to the reference voltage, the switch SW1 becomes unconductive, so that the charging of the condenser C1 is stopped and the charges of the condenser C1 are abruptly discharged to thereby reset the timer 4. Therefore, in the case of reopening the copying operation within the predetermined time during the manual exposure control mode, the keep relay RL is prevented from receiving a set signal.

When the copying machine is left without operation after the completion of the copying cycle, the keep relay RL is set in the same manner as above described.

Thus, the timer 4 is automatically started upon the power voltage supply start or after its reset condition. When the mode selection switch is actuated during the cases other than the copying cycle, or the copying cycle has been completed, the timer 4 is reset. The keep relay RL is forcibly set when it is left without being operated for a predetermined time after the start of the timer 4, or upon the power supply start. Thus, even if the manual exposure control mode is selected to conduct the copying operation, but the copying machine is left unoperated for a predetermined length of time, the automatic exposure control mode is automatically returned.

The automatic exposure control mode is automatically selected in anyone of the following conditions:

1. When the document to be copied has a normal shade, in other words, the automatic exposure control mode should be more frequently used than the manual exposure control mode.

2. A next copying operation is not conducted within a predetermined length of time after some copying operation has been completed.

3. The manual exposure control mode is not selected within a predetermined length of time after having selected the manual exposure control mode.

4. The power source is started to be supplied.

Therefore, normally, the operator can assume that the copying machine is placed in the automatic exposure control mode in conducting the copying operation. He can ignore setting the light exposure control. Any possible mis-copy due to the light exposure control can be eliminated.

Another preferred embodiment of the present invention in which a copy magnification changeable type electrophotographic copying machine comprises an exposure setting circuit for forcibly setting the exposure control mode setting switch circuit in the automatic exposure control mode in response to the actuation of a magnification selection switch.

Figure 2:
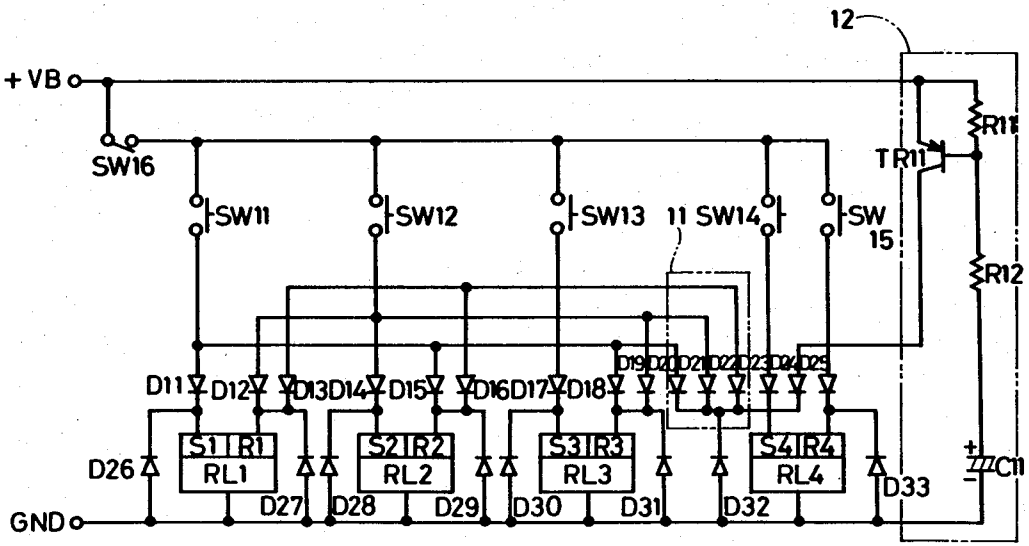
FIG. 2 is a diagram of an automatic exposure mode selection circuit for automatically selecting an automatic exposure control mode for a magnification-changeable type electrophotographic copying machine according to a second preferred embodiment of the present invention.

FIG. 2 is a configuration of a mode setting circuit of a magnification changeable electrophotographic copying machine according to a second preferred embodiment of the present invention.

Three scale control switches SW11–SW13 and two mode selection switches SW14 and SW15 are disposed in the control panel of the copying machine. The first scale switch SW11 is operated to select an equal-size copy mode. The second scale switch SW12 is operated to select a reduction copy mode. The third scale switch SW13 is operated to select a magnification copy mode. The switch SW14 is actuated to select the automatic exposure control mode. The switch SW15 is actuated to select the manual exposure control mode.

The three scale switches SW11–SW13 are connected to set terminals S1–S3 of scale setting keep relays RL1–RL3, respectively. The scale setting keep relays RL1–RL3, when set, select the equal-scale copy mode, the reduction mode, and the magnification mode, respectively. While each of the scale switches SW11–SW13 is connected to one of the set terminals of the scale setting keep relays SW11–SW13, each of the scale switches SW11–SW13 is connected to a reset terminal of each of the remaining scale setting keep relays. Then, when anyone of the scale switches SW11–SW13 is actuated, only the keep relay having the set terminal connected to the actuated scale switch is set. For example, the scale switch SW11 is connected to a set terminal S1 of the keep relay RL1 while it is connected to reset terminals RL2 and RL3 of the keep relays RL2 and RL3. If either the keep relay RL2 or the keep relay RL3 is set, the scale switch SW11 is operated so that either the keep relay RL2 or the keep relay RL3 of each set is reset and only the keep relay RL1 is set. Similarly, when the scale switch S12 is operated, only the scale setting keep relay R12 is set. When the scale switch SW13 is operated, only the scale setting keep relay RL3 is set. A central processing unit (CPU) may be provided for detecting the set conditions of the scale setting relays RL1–RL3. The CPU is provided for controlling the operation of the copying machine. In response to the set conditions detected, an optical scanning system is adjusted. The magnification control system for adjusting the optical system may be conventional.

The mode selection switch assembly includes the automatic exposure control mode selection switch SW14 and the manual exposure control mode selection switch SW15. These switches SW14 and SW15 are connected to a set terminal S4 and a reset terminal R4 of an exposure control mode setting keep relay RL4, respectively. The exposure control mode setting keep relay RL4 functions to select either the automatic exposure control mode or the manual exposure control mode. When the keep relay RL4 is set, the automatic exposure control mode is selected. While it is reset, the manual exposure control mode is selected.

As similar to the above-described preferred embodiment, during the automatic exposure control mode, the copying machine can optically detect the shade of the document to be copied and mounted on the document table. The light exposure is controlled based on the shade detected.

The keep relay RL4 is set by the automatic exposure control mode setting switch SW14 and reset by the manual exposure control mode setting switch SW15. To the set terminal S4 of the keep relay RL4, an automatic exposure control mode selection circuit 11 and a power-supply start mode selection circuit 12 are connected. The automatic exposure control mode selection circuit 11 includes diodes D20–D22, respectively, connected to the scale switches SW11–SW13. When anyone of these scale switches SW11–SW13 is actuated, the keep relay RL4 is forcibly set. The power supply start mode selection circuit 12 forms a one-shot pulse in response to the start of the power supply, so that the one-shot is applied to the set terminal S4 of the keep relay RL4 to thereby forcibly set the keep relay RL4.

Thus, according to the present invention, when anyone of the scale switches SW11–SW13 is operated, the exposure mode selection keep relay RL4 is forcibly set, regardless of whether either the automatic exposure control mode or the manual exposure control mode has been already selected, whereby the automatic exposure control mode is automatically selected in the copying machine. In other words, when the magnification is changed in the copying machine, the automatic exposure control mode is necessarily selected.

In the above second preferred embodiment of the present invention, it is described that, to return the automatic exposure control mode after selecting the manual exposure control mode, the scale switches SW11–SW13 or the automatic exposure selection switch SW14 must be operated. However, it may be possible that a timer is provided for starting the timing counting operation after the copying operation regardless of the selected exposure control mode, and automatically returning the copying machine to the automatic exposure control mode after the copying machine is left unoperated for a predetermined length of time. Such a timer may be easily provided with reference to the teaching of the first preferred embodiment of the present invention.

According to the feature of the second preferred embodiment of the present invention, the operator can assume after changing the magnification that the automatic exposure control mode is necessarily selected. Further, when the power supply is started, the power supply start mode setting circuit 2 is automatically operated to forcibly set the exposure mode selection keep relay RL4, so that the automatic exposure control mode is automatically selected.

While only certain embodiments of the present invention have been described, it will be apparent to those skilled in the art that various changes and modifications may be made therein without departing from the spirit and scope of the present invention as claimed.

What is claimed is:

1. An electrophotographic copying machine comprising:

exposure control means for controlling the exposure during a copying operation of the electrophotographic copying machine by varying the intensity of light supplied to expose a copy document, said means for controlling being operable in an automatic exposure control mode in which an amount of light supplied to expose the copy document is automatically determined and a manual exposure control mode in which an amount of light supplied to expose the copy document is manually set;

first means for automatically selecting said automatic exposure control mode of said exposure control means in response to an initial supply of power to said copying machine;

manual switch means for selecting between the automatic exposure control mode and the manual exposure control mode of said exposure control means;

means for counting a predetermined length of time after the occurrence of the copying operation in either of the automatic exposure control mode or the manual exposure control mode, said means for counting being reset when said automatic exposure selection control mode is selected during a non-copying cycle, or after the completion of any copying cycle, said means for counting being set after said reset operation or upon the initiation of the supply of power to said copying machine; and second means for automatically selecting said automatic exposure control mode in response to the lapse of said predetermined length of time.

2. The copying machine of claim 1, further including a magnification control switch for selecting a copy magnification level.

3. The copying machine of claim 2, wherein said second means for automatically selecting said automatic exposure control mode is operated in response to an operation of said magnification control switch.

4. The copying machine of claim 1, wherein said means for counting a predetermined length of time is a RC time constant charge circuit.

* * * * *